US007568525B2

(12) United States Patent
Veselkov

(10) Patent No.: US 7,568,525 B2
(45) Date of Patent: Aug. 4, 2009

(54) METHOD AND SYSTEM FOR INCREASING WELL RATE USING WELL-CAPITAL-STRING PERFORATION

(75) Inventor: Sergey Nikolayevich Veselkov, Moscow (RU)

(73) Assignee: Nord Service, Inc., Little Rock, AR (US)

( * ) Notice: Subject to any disclaimer, the term of this patent is extended or adjusted under 35 U.S.C. 154(b) by 134 days.

(21) Appl. No.: 11/236,438

(22) Filed: Sep. 27, 2005

(65) Prior Publication Data

US 2006/0086504 A1 Apr. 27, 2006

Related U.S. Application Data

(60) Provisional application No. 60/613,276, filed on Sep. 27, 2004.

(51) Int. Cl.
*E21B 43/114* (2006.01)
*E21B 43/26* (2006.01)

(52) U.S. Cl. ..... 166/298; 166/55; 166/177.5; 166/308.2

(58) Field of Classification Search ..... 166/308.1, 166/197, 298, 55, 55.1, 319, 321, 177.5, 166/249, 308.2, 297
See application file for complete search history.

(56) References Cited

U.S. PATENT DOCUMENTS 2,670,801 A * 3/1954 Sherborne ..... 166/249
2,915,122 A * 12/1959 Hulse ..... 166/249
3,389,759 A * 6/1968 Mori et al. ..... 175/258
3,933,205 A * 1/1976 Kiel ..... 166/308.1
4,022,275 A * 5/1977 Brandon ..... 166/249
4,227,582 A * 10/1980 Price ..... 175/16
4,665,980 A * 5/1987 Bodine ..... 166/249
5,445,220 A * 8/1995 Gurevich et al. ..... 166/55
6,651,741 B2 11/2003 Bassin et al.

FOREIGN PATENT DOCUMENTS

| | | | |
|---|---|---|---|
| GB | 2231405 A | * | 11/1990 |
| RU | 2015749 | | 7/1994 |
| RU | 2058477 | | 4/1996 |
| RU | 2061847 | | 6/1996 |
| RU | 1369379 | | 12/1996 |
| RU | 2117137 | | 8/1998 |
| RU | 2137900 | | 9/1999 |
| RU | 2151857 | | 6/2000 |
| RU | 2151858 | | 6/2000 |

(Continued)

*Primary Examiner*—Kenneth Thompson
(74) *Attorney, Agent, or Firm*—Houston Eliseeva LLP

(57) ABSTRACT

The method of wells production rate increase which includes lowering the hydroperforator equipped with hydromonitor nozzles into the well on the pipe string; pumping liquid with abrasive material under pressure into the pipe string and hydroperforator; impacting the well elements and the stratum with the liquid with abrasive material via hydroperforator hydromonitor nozzles. When liquid with abrasive material impacts the well elements and the stratum, pressure is changed in the pipe string delivering the liquid with abrasive material. The difference is that pressure is changed over time so that pressure oscillations always include components with different frequencies, and in doing so, peak values (amplitudes) for at least some pressure oscillation components vary within the time interval $T_d$, where $T_d \leqq T_v$; $T_v$ being the time of impact of the liquid with abrasive material on the well elements and the stratum via hydroperforator hydromonitor nozzles.

21 Claims, 8 Drawing Sheets

FOREIGN PATENT DOCUMENTS

| | | |
|---|---|---|
| RU | 2162509 | 1/2001 |
| RU | 2163294 | 2/2001 |
| RU | 2190759 | 10/2002 |
| RU | 2197335 | 1/2003 |
| RU | 2197598 | 1/2003 |
| RU | 2205941 | 6/2003 |
| RU | 2231620 | 6/2004 |

* cited by examiner

Table 1
Natural oscillation frequencies of the pipe string

| Number of the harmonic | Natural oscillation frequencies (Hz) for the length of the pipe string 3000 m | Natural oscillation frequencies (Hz) for the length of the pipe string 2000 m | Natural oscillation frequencies (Hz) for the length of the pipe string 1000 m |
|---|---|---|---|
| 1 | 0.42 | 0.63 | 1.26 |
| 2 | 1.56 | 2.34 | 4.63 |
| 3 | 2.1 | 3.15 | 6.3 |
| 4 | 2.94 | 4.41 | 4.41 |
| 5 | 3.78 | 5.67 | 5.61 |
| 6 | 4.62 | 6.93 | 13.86 |
| 7 | 5.46 | 8.19 | 16.38 |
| 8 | 6.3 | 9.45 | 18.9 |
| 9 | 7.14 | 10.71 | 21.42 |
| 10 | 7.98 | 11.97 | 23.94 |

Fig.3

Table 2
Modes of operation of the hydraulic jet perforator and pressure pulsators in the process of production casing, cement stone and stratum slotting

| Time intervals, min | Hydroperforator operation | Pulsator # 1 operational (Hz), Amplitude – 3 | Pulsator # 2 operational (Hz), Amplitude – 1 | Pulsator #3 operational frequency (Hz), Amplitude – 0.3 MPa |
|---|---|---|---|---|
| 0-5 | Opening the | 1 | 60*) | |
| 5-10 | production casing and cement stone | 1.3 | 60 | |
| 10-15 | Slotting in the | 1.7 | 70 | 254 |
| 15-20 | production casing, | 2 | 70 | 150 |
| 20-25 | cement stone | 3.5 | - | – |
| 25-30 | and the stratum | 4 | 150 | – |
| 30-35 | | 5 | 80 | 300 |
| 35-40 | | 4 | 40 | 250 |
| 40-45 | | 5 | 70 | 200 |
| 45-50 | | 4 | 50 | 200 |
| 50-55 | | 1.6 | 50 | 150 |
| 55-60 | | 1.4 | 60 | 150 |

*) for countries using industrial current frequency 60 Hz, pulsator should be operated at 40 or 70 Hz. Pulsator operation at 60Hz must be avoided.

Fig.4

Table 3
Modes of operation of the pressure pulsators during flushing of the pipe string, annular space and stratum key seat

| Time intervals, min | Pulsator # 1 operational frequency Amplitude – 0.3 MPa | Pulsator # 2 operational frequency Amplitude – 0.1 MPa | Pulsator # 3 operational frequency Amplitude – 0.01 MPa |
|---|---|---|---|
| 0-1 | 300 | 1000 | 10000 |
| 1-2 | 350 | 1100 | 10000 |
| 2-3 | 400 | 1200 | 10000 |
| 3-4 | 450 | 1300 | 10000 |
| 4-5 | 500 | 1400 | 10000 |
| 5-6 | 450 | 1300 | 12000 |
| 6-7 | 400 | 1200 | 1200 |
| 7-8 | 350 | 1100 | 12000 |
| 8-9 | 300 | 300 | 12000 |
| 9-10 | 250 | 900 | 12000 |

Fig. 11

Table 4
Modes of operation of the pressure pulsators during flushing of the pipe string, annular space and stratum key seat

| Time intervals, min | Pulsator # 1 operational frequency Amplitude – 3 MPa | Pulsator # 2 operational frequency Amplitude – 1 MPa | Pulsator # 3 operational frequency Amplitude – 0.3 MPa |
|---|---|---|---|
| 0-5 | 0.1 | 0 | 150 |
| 5-10 | 0.2 | 0 | 204 |
| 10-15 | 0.3 | 0 | 250 |
| 15-20 | 0.6 | 70 | 250 |
| 20-25 | 0.7 | 100 | 350 |
| 25-30 | 1.0 | 100 | 350 |

Fig. 12

METHOD AND SYSTEM FOR INCREASING WELL RATE USING WELL-CAPITAL-STRING PERFORATION

RELATED APPLICATIONS

This application claims the benefit of the earlier filing date under 35 U.S.C. 119(e) of U.S. provisional application Ser. No. 60/613,276 filed on Sep. 27, 2004 which is incorporated herein by reference in its entirety.

FIELD OF INVENTION

The invention belongs to the area of liquid minerals operation, in particular, to the oil and gas industry, as well as subterranean water extraction. It may be used to create hollow key seats in the stratum by slotting the well production casing, cement stone and productive stratum of liquid minerals. In addition, the invention may be used for channel hydraulic jet perforating of the elements of the well and of the productive stratum.

BACKGROUND OF THE INVENTION

A. A method of oil, gas and hydrogeological wells production rate increase is adopted as analogous. That method was described in U.S. Pat. No. 6,651,741 published on Apr. 17, 2003. The method includes slot perforation of the production casing and stratum only in the vicinity of the borehole and pumping treating fluid in the well and key seat. Slot perforation is performed with the use of a hydroperforator within the interval of lowest inflow values by developing two diametral oppositely oriented slot key seats in the stratum. With all advantages of this method, it is not free of shortcomings. The main shortcoming is that in the process of perforating, jet pressure does not pulsate. That, in turn, reduces the force the jet applies to the stratum surface being treated, lowers perforation efficiency, and as a result, requires extra time of perforator operation.

B. An analogous method of increasing the productive stratum permeability is also known (USSR Author's Certificate # 1369379, published on Dec. 10, 1996). The method includes creation of vertical discharge slots in the well. This method, as well as the previous mentioned, has the same shortcoming: jet pressure does not pulsate, thus requiring extra time of perforator operation.

C. As well, an analogous method is known of increasing the well production rate, which is put forward in the Russian Federation Patent 2190759 published on Oct. 10, 2002, entitled "Hydraulic perforator". The perforator design was improved in comparison with the previous analogous methods, thanks to the pressure pulsator with which the perforator was equipped. In this analogous method is included pumping of liquid with abrasive material under pressure into the pipe string and hydroperforator; liquid with abrasive material impacts the well elements and the stratum via the hydroperforator hydromonitor nozzle; when the liquid with abrasive material impacts the well elements and the stratum, pressure changes in the pipe string deliver liquid with abrasive material.

This analogous method also has essential shortcomings. For example, when it is implemented, pressure oscillations are generated at one frequency only, and, should the pulsator operating frequency be equal to the natural oscillation frequency of any equipment element, the pulsator operating frequency cannot be changed. The work using such a method does not reduce the risk of resonance and of breakdown equipment breakdown.

D. As the prototype of the disclosed method of well production rate increase, we adopt the known invention per the Russian Federation Patent 2061847 published on Jun. 10, 1996 and entitled "Pulse hydraulic perforator". In the named patent, a method of well production rate increase and of perforator efficiency enhancement is described. The method (prototype) of well production rate increase, includes lowering the hydroperforator equipped with hydromonitor nozzles into the well on the pipe string; pumping liquid with abrasive material under pressure into the pipe string and hydroperforator; and impacting the well elements and the stratum with the liquid with abrasive material via hydroperforator hydromonitor nozzles. When the liquid with abrasive material impacts the well elements and the stratum, pressure is changed in the pipe string, delivering the liquid with abrasive material. The hydroperforator contains the pressure pulses generator. The pressure pulses generator, in the process of its operation, ensures the increase of the effect of the perforating jet of liquid on the stratum surface being crushed, as well as its impact on the deep-seated layers of the stratum adjacent to the key seat surface, thanks to pressure oscillations. The pressure pulses also spread upwards, towards the wellhead, in the liquid flowing from the wellhead to the perforator along the tubing string (TS) column.

The features of the prototype which coincide with the features of the method of well production rate increase disclosed in the present application, are as follows:

a) the method of well production rate increase;

b) lowering the hydroperforator equipped with hydromonitor nozzles into the well on the pipe string;

c) pumping liquid with abrasive material under pressure into the pipe string and hydroperforator;

d) impacting the well elements and the stratum with the liquid with abrasive material via hydroperforator hydromonitor nozzles;

e) when liquid with abrasive material impacts the well elements and the stratum, pressure is changed in the pipe string delivering the liquid with abrasive material.

The shortcoming of the prototype is the fact that when it is implemented, pressure oscillations are generated at one frequency only, thus ensuring effective impact only on the minor part of the stratum inner layers adjacent to the key seat surface. As it is known, the fixed frequency of pressure oscillations results in the fixed depth of the mud-pulse impact on the stratum. The impact depth is inversely proportional to the square root of the oscillations frequency (see Russian Federation Patent 2162509 published on Jan. 27, 2001).

Another significant shortcoming of the prototype is the fact that, should the pulsator operating frequency be equal to the natural oscillation frequency of any equipment element (TS, pumping units, perforator, fittings, etc.), the frequency of generated pressure pulses cannot be changed, thus possibly causing the equipment element to operate in the resonance mode. Keeping in mind that the perforation time can last up to several hours, breakdown of the equipment operating in the resonance mode becomes possible, and that occurs frequently in the process of operating such perforators. TS rupture in the resonance mode and its destruction before the bottom hole may cause loss of the well.

In addition, sequence of work and characteristics of impact on the well elements and on the stratum were not optimized in the prototype. Some operations could be combined. For example, stratum perforation and impact on the stratum layers adjacent to the key seat surface could be performed simultaneously. That, in turn, would increase production performance in the future and would reduce the overall time of operations required to recover the well.

SUMMARY OF THE INVENTION

The disclosed method of increasing the well production rate (for production and delivery wells) is intended to create hollow key seats in the stratum by slotting the well production casing, cement stone and productive stratum of liquid minerals—in particular, hydrocarbons, water, etc. Specific examples of the intended use of the invention are shown below in this section and in the section "Implementation of the Invention".

Perforation of the well and stratum elements is performed with the use of the hydraulic perforator (hydroperforator). The hydroperforator is a mechanism including one or several hydromonitor nozzles (nose-pieces). In addition, the hydroperforator may include cutting, rolling or piercing disks (see Russian Federation Patents 2058477, 2163294, 2151858, 2205941 and others), auger bits, and cumulative explosives.

The purpose of the invention is to reduce material and labor expenses in the process of operations on increasing well production rate.

The purpose of the invention is achieved thanks to the fact that the method of well production rate increase includes lowering the hydroperforator equipped with hydromonitor nozzles into the well on the pipe string; pumping liquid with abrasive material under pressure into the pipe string and hydroperforator; and impacting the well elements and the stratum with the liquid with abrasive material via hydroperforator hydromonitor nozzles. When liquid with abrasive material impacts the well elements and the stratum, pressure is changed in the pipe string, delivering the liquid with abrasive material. Pressure is changed over time so that pressure oscillations always include components with different frequencies, and in doing so, peak values (amplitudes) for at least some pressure oscillation components vary within the time interval $T_d$, where $T_d \leqq T_v$;

$T_v$ being time of impact of the liquid with abrasive material to the well elements and the stratum via hydroperforator hydromonitor nozzles.

The features of the disclosed method which differ from the features of the prototype are as follows:

a) when liquid with abrasive material impacts the well elements and the stratum, pressure is changed over time so that it includes pressure oscillation components with different frequencies;

b) peak values of at least some pressure oscillation components vary within the time interval $T_d$, c) $T_d \leqq T_v$ Technological results which will be achieved upon implementation of the invention.

One technological result that will be achieved in the process of implementation of the invention will be the reduction of operation time required to increase well production rate. Reduction of operation time is achieved thanks to simultaneous operations on perforation and impacting the well production casing and productive stratum with the pressure waves of different frequencies via the stratum key seats. In addition, that time is reduced by optimizing the sequence of work and characteristics of impact on the well elements and the stratum.

The second technological result in the process of implementation of the invention will be effective cleaning of sediments off the inner and outer surface of the pipe string and off the inner surface of the production casing, thanks to impacting them with the pressure waves at different frequencies.

The third technological result will be more even impacting, with pressure waves, of the short-range and long-range layers of the stratum adjacent to the surface of the key seat impacted by liquid with abrasive material. More even impacting with pressure waves occurs because of changes in time of the intervals between peak values of pressure. The longer the intervals between peak values of pressure are, the deeper the disturbance penetrates in the stratum. And vise versa—if the intervals between peak values of pressure are short, it reduces the depth of the disturbance penetration in the stratum. Such wave disturbances in the stratum intensify mass exchange and cause the increase of the fluid inflow.

The technological result will be enhancement of the equipment elements performance reliability in the process of slotting the well production casing, behind-the-casing cement stone and rocks of the productive stratum, thanks to shortening operation time of the equipment elements in the resonance and near-resonance modes.

Currently, using the public sources of scientific, research and patent information, we are not aware of any methods of well hydraulic jet perforating targeted to the stratum slot relief, which, together with known essential features, would include the new set of essential features which we propose.

In combination, the known and new essential distinctive features of the method ensure achieving the aforementioned new technical results by the invention disclosed, if implemented.

While implementing the disclosed method, pressure is changed over time so that for some pressure oscillation components, peak values of pressure (pressure oscillations amplitudes) change within the interval of time $T_d$. The $T_d$ time interval consists of one time period or of several consecutive time periods.

Pressure is changed in the pipe string by the pressure pulsator. Each pressure oscillation component is generated by the respective pressure pulsator, and the mode of operation of the pressure pulsator is changed over time: for example, the amplitude of pulses is increased or decreased for a certain given frequency. Modes of operation of the pressure pulsators will be described in detail in the section "Implementation of the Invention".

Another mode of operation of the pressure pulsator may be the one where the generated pulse frequency is changed discretely or continuously, the amplitude of pulses remaining constant.

It is expedient to use electrohydraulic pulsators as pressure pulsators. The graphic layout of the pulsator and its operation will be described below.

Other than a electrohydraulic pulsator, other types of pulsators may be used as well, e.g. hydraulic pulsators (hydropulsators), also known as vibrators. The design of hydropulsators is described in the Russian Federation Patents 2015749, 2162509, 2137900, 2231620, 2197598, 2197335, 2117137, 1312819, and on the website http://pfvniibt.permonline.ru/rus/prod/gp.html.

In the process of operation, pulsators generate compression waves in the liquid. The compression waves overlap, and as a result, pressure in the jet flowing out of the hydromonitor nozzle pulsates, thus increasing the penetrating performance of the jet. Simultaneously, compression waves impact the subsurface and deep-seated layers of the stratum, intensifying mass exchange processes in them. In addition, compression waves crush sediments deposited on the surface of the pipe string and production casing thanks to cavitation occurring near the surface of pipes as a result of wave extinction.

And the most important feature: the mode of operation of pulsators is selected so that the pulsators work for the minimum time at the maximum intensity at the frequencies equal or close to the natural oscillation frequencies of the well equipment elements and of the surface equipment connected to the well.

Thanks to the fact that in the disclosed method proposes to simultaneously perform operations on the stratum slotting, on impacting stratum layers adjacent to the key seat with the pressure pulses, and cleaning pipe surfaces without having to raise the pipe string from the well and lower additional equipment, it reduces the time of operations and, at the same time, significantly reduces the material and labor expenses required to recover the well. With the proposed method implemented, it becomes unnecessary to use any additional special equipment for operations on the borehole sediments cleaning after performing hydraulic jet perforating.

Below, a detailed description of all the possible nuances and features of the invention is given.

When the method is implemented, the peak value of pressure increases for at least one component of pressure oscillations within $T_d$ time interval. That operation is performed by increasing the pressure pulsator power output at the same frequency. That mode of operation is most simple in its implementation for any type of pulsators. That mode allows pressure oscillations amplitude to increase at one certain depth of the stratum over time, thus, in turn, intensifying mass exchange in that given part of the stratum. In the proposed method, the number of components of pressure oscillations is determined by the number of pressure pulsation sources—in particular, by the number of pressure pulsators of different types and of other mechanic devices used to implement the method.

When the method is implemented, the peak value of pressure decreases for at least one component of pressure oscillations within the $T_d$ time interval. That mode allows pressure oscillations amplitude to decrease at one certain depth of the stratum over time, thus, in turn, intensifying mass exchange (flows from the high-pressure area to the low-pressure area) in that given part of the stratum.

That process is especially effective when vibration treatment of the stratum is performed at different frequencies, meaning that at different distances from the key seat, different areas of the stratum are treated simultaneously.

When the method is implemented, the peak value of pressure for at least one component of pressure oscillations within $T_d$ time interval, the peak value of pressure $P_{it1}$ within the T1 time period, differs from the peak value of pressure $P_{it2}$ within the T2 time period (see FIG. 9), Here $P_{it1}$ is the peak pressure value for the i-th pressure oscillation component within the t1 time period;

$P_{it2}$ is the peak pressure value for the i-th pressure oscillation component within the t2 time period;

T1 and T2 are consecutive time periods within the $T_d$ time interval or are separated by some non-zero time period.

i is a number of the harmonic of the definite frequency, when the latter is equal to the operational frequency of the pressure pulsator. That mode is realized when the pulsator is turned off before switching to another mode of operation, i.e. when some period of time is required to tune the pulsator to another mode of operation, i.e. if the flow breaker is to be replaced in the pulsator. Breaks in the pulsators operation are also necessary to avoid electromagnets overheating.

Maximum value of pressure $P_{it1}$ generated by the pulsator in one time period differs from the maximum value of pressure $P_{it2}$ generated by the pulsator in another time period by a factor of between 1.01 to 100. That range of variation in the pressure oscillations amplitude is realized in virtually any type of pulsators. The range can be extended; however, a pulsator with such an extended range will cost more and its reliability decreases.

When the method is implemented, at least for one component of the pressure oscillations, the peak pressure value $P_{it1}$ is higher than the peak pressure value $P_{it2}$ by a factor of between 1.01 to 100. This special case of the pressure change is realized when the power output of the pressure pulsator decreases over time. Pressure pulse power output is decreased upon slotting of the production casing and cement stone. As the strength of rocks is significantly lower than the strength of the steel production casing, the amplitude of pressure oscillations should be reduced.

When the method is implemented, at least for one component of the pressure oscillations, the peak pressure value $P_{it1}$ is lower than the peak pressure value $P_{it2}$ by a factor of between 1.01 to 100. This special case of the pressure change is realized when the power output of the pressure pulsator increases over time. It is expedient to increase the amplitude of pressure oscillations when a long slot key seat needs to be slotted in the rock. While the slot key seat gets longer, the force of the jet impact on the rock decreases, and to make up for that decrease, it is necessary to increase the amplitude of pressure oscillations in the jet (in other words, to increase the magnitude of pressure pulses).

When the method is implemented, at least for some components of the pressure oscillations, the peak pressure value is changed by a factor of between 1.01 to 100 within the time interval $T_d$. As experience shows, it is necessary to change the amplitude of oscillations at different frequencies simultaneously, as each frequency solves its own problem in the process of the operation: lower frequencies of pressure oscillations impact the long-range layers of the stratum with respect to the key seat, while the higher frequencies impact those immediately adjacent to the key seat.

Different types of pulsators generate pulses in different frequency ranges. Electrohydraulic pulsators are capable of efficiently generating pressure pulses at frequencies ranging from singles to tens and hundreds of thousand Hz, with amplitudes ranging from 5 MPa to 0.05 MPa and lower. The higher the frequency, the lower the amplitude. Pulsators based on the helical hydraulic motors generate pulses within the frequency range of 15 to 20 Hz with amplitude up to 5 MPa.

To generate pressure pulses at lower frequencies between 0.001 to 100 Hz, plunger pumps may be used, as well as metering units. Plunger pumps have the feature of adjusting the supply and pressure.

Before the liquid with abrasive materials is pumped to the pipe string and hydroperforator to augment the efficiency of slotting operations, the well is to be flushed out to its bottom by pressure pumping the well flushing solution into the pipe string, hydroperforator and well annular space with the use of the pumping unit. In particular, the flushing solution may be a solution containing a chemical, e.g. KCl, with the density of 0.70 to 1.35 g/cm$^3$ (in some cases of abnormal wells, the solution density may be up to 2.0 to 3.5 g/cm$^3$). In doing so, pressure is changed in the pipe string where the solution is supplied for flushing the well. Flushing allows for cleaning some sediments off the production casing surface and the bottom hole before slotting commences, thus resulting in lowering hydraulic losses as slotting progresses. While the well is being flushed out to the bottom, the pressure pulsator is to be checked for operation capability. Pressure pulses in the flushing liquid result in increased cleaning efficiency of the production casing surface.

While the well is flushed to the bottom, pressure in the pipe string and in the annular space is changed over time so that it includes harmonic components of different frequencies, and, for at least a part of pressure oscillation components, peak values of pressure vary within the $T_r$ time interval, where $T_r \leqq T_f$;

$T_f$ is time of well flushing out to the bottom. The $T_r$ time interval consists of one period of time or of several periods.

As sediment densities may be significant, it is expedient to measure the amplitudes and frequencies of pressure oscillations in the flushing liquid with the aim of impacting both surface and subsurface layers in the sediments.

Numerous research studies and practical experience show that, prior to pumping liquid with abrasive material into the pipe string and hydroperforator, and prior to flushing the well, it is necessary to perform a pressure test of the pipe string and the perforator by applying pressure to the pipe string mouth which by 1.15 to 3 times exceeds the pressure there when the well elements and the stratum are impacted by the liquid with abrasive material via the hydroperforator hydromonitor nozzles. In doing so, while the pressure test is performed, pressure is changed in the pipe string. In the process of the pressure test of the pipe string and the perforator, pressure is changed over time so that it includes harmonic components of different frequencies, and, for at least a part of the components of pressure oscillations, peak values of pressure vary within the Ts time interval, where $Ts \leqq T_0$;

$T_0$ is time interval of the well and perforator pressure test. $T_r$ time interval consists of one period of time or of several consecutive periods.

Checking of pressure pulsators operation during pressure testing for all the modes expected during the operation ensures prevention of emergency situations during the stratum relief, and avoids personnel injuries and death.

After liquid with abrasive material impacts the well elements and the stratum, the well and the stratum key seat are to be flushed and treated with the solution containing a chemical, e.g. KCl, and simultaneously, pressure is to be changed in the pipe string which supplies the solution for flushing the well. During flushing, the flushing liquid fills all the inner holes of the well, including slot key seats, which may be two, four, six, or more. Pressure changes in the pipe string filled with the flushing liquid cause pressure changes in the slot key seats also filled with the flushing liquid. Pressure pulses at different frequencies stimulate mass exchange processes in the stratum, both near the slot key seat surface and away from it.

Flushing may be combined with chemical treatment of the stratum. Then, after liquid with abrasive material impacts the well elements and the stratum, the well and the key seat in the stratum is to be flushed with the solution having acidic or alkaline reaction, and in doing so, pressure is changed in the pipe string which delivers the solution. Pressure pulses at different frequencies stimulate the processes of the solution interaction with clayish formations located in the stratum (collector) both near the key seat surface and away from it.

Pressure is changed over time so that it contains harmonic components with different frequencies, and at least some of the pressure oscillation components change within the $T_j$ time period, here $T_j \leqq T_w$;

$T_w$ is the flushing time of the well and the stratum key bed. At least for one pressure oscillation component, the peak value of pressure may increase or decrease within the $T_j$ time period. At least for some pressure oscillation components, peak values of pressure may change by a factor of 1.01 to 100, within the $T_j$ time period.

The necessity and efficiency of these measures were described above.

Pressure is changed in such a way that it includes harmonic components of different frequencies. Harmonic oscillations are realized most naturally, as they change in accordance with sine or cosine law. For example, electrohydraulic pulsators operating at the industrial current frequency generate pressure pulses at the same or multiple frequencies. Most electric frequency converters generate sine signals.

Liquid with abrasive material is pumped under pressure into the pipe string and hydroperforator with the aid of a pump (or pumps), or by compressed gas supplied by the pressure accumulator.

The hydroperforator may be attached to the lower end of the pipe string or to the lower part of the motor—subsurface device for the hydroperforator axial movement. In turn, the subsurface device for the hydroperforator axial movement is attached with its upper end to the lower end of the pipe string.

Subsurface device for the hydroperforator axial movement (also called "vertical movement") contains a cylindrical casing and a hollow rod installed coaxially to it, which is rigidly connected to the hydroperforator in its lower part and is capable of moving against the casing. That hollow rod together with the casing make a ring chamber filled with viscous liquid (oil). A piston is attached to the hollow rod. The ring chamber is divided into two sections by the wall having a channel for the liquid to flow through. In one of the parts of the ring chamber, a spring is located which enables movement of the piston and the rod against the casing. The design of the subsurface device is described in the Russian Federation Patent 2151857 published on Jun. 27, 2000.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIG. 3 shows Table 1 with the results of calculations of the natural oscillation frequencies of the pipe string attached to the well mouth.

FIG. 4 shows Table 2 with the modes of operation of the hydraulic jet perforator and pressure pulsators in the process of production casing, cement stone and stratum slotting.

FIGS. 11 and 12 show Tables 3 and 4 with the modes of operation of the pressure pulsators during flushing of the pipe string, annular space and stratum key seat.

DETAILED DESCRIPTION OF THE PREFERRED EMBODIMENTS

Figure 1:
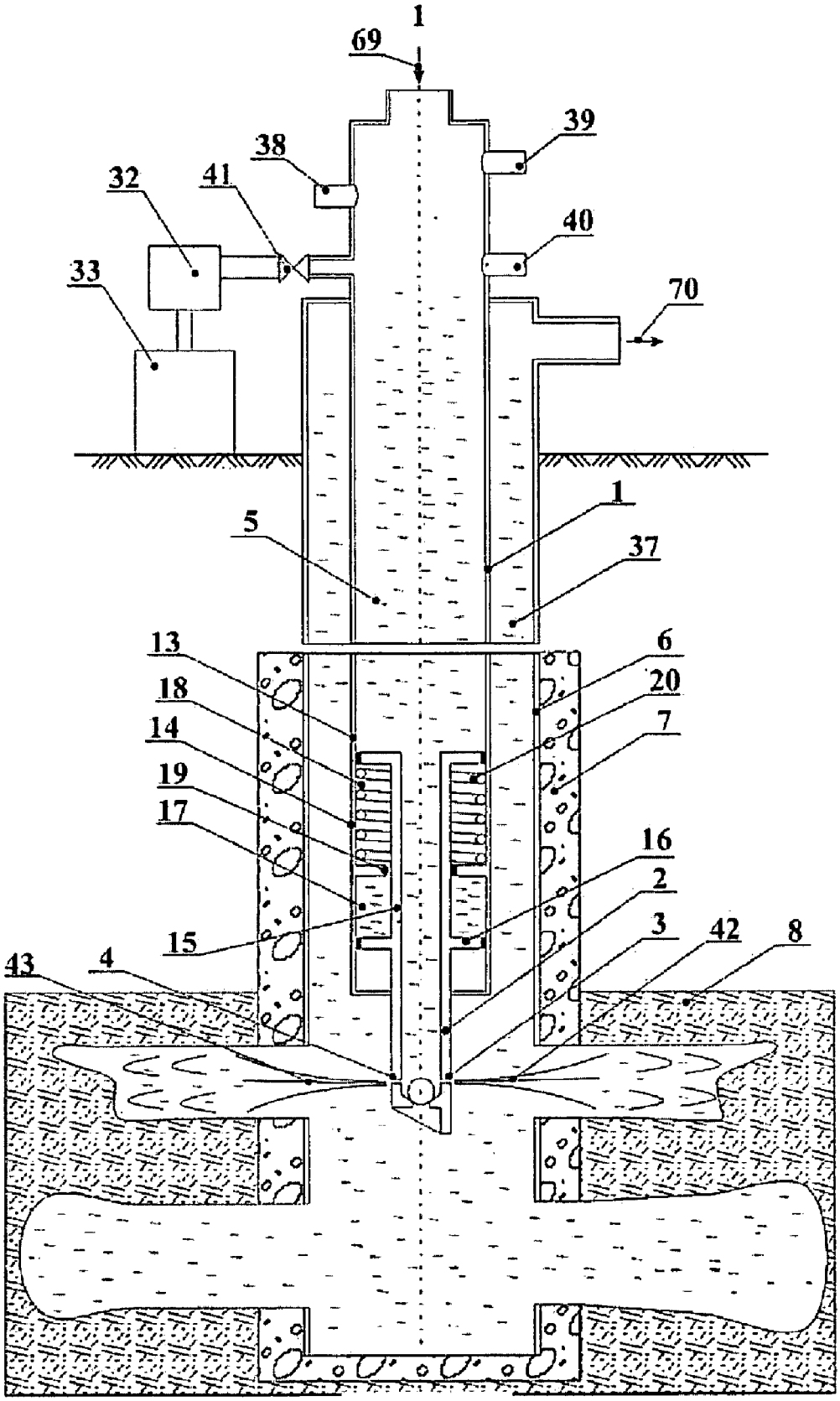
FIG. 1 shows the subsurface equipment required to implement the disclosed method.

While this invention has been particularly shown and described with references to preferred embodiments thereof, it will be understood by those skilled in the art that various changes in form and details may be made therein without departing from the scope of the invention encompassed by the appended claims.

Based on the modem views of theoretical hydromechanics of the productive stratum well bore zone, after drilling, ring compressive strains occur in the well bore zone which significantly reduce the well bore zone permeability. As well, the well bore zone permeability reduces due to deposition of the hard phase of the flushing liquid in the collector.

The productive stratum completion is performed with a hydroperforator by its progressive movement along the well axis and, possibly, rotating it about the well axis within the productive stratum interval. During the operation, linear or helical key seats (slots) are created along the well axis on both sides of the well bore in diametral opposite directions covering the full depth of the productive stratum.

These slots convert ring compressive strains in the well bore zone into stretching strains. Due to that, rock strains of the productive stratum well bore zone are relieved and, as a consequence, rock permeability increases. So does the well production.

It is reasonable to combine the process of creation of linear or helical well bores (i.e. performing slot perforation) in the stratum with another process of the stratum treatment currently in use, namely, with the stratum treatment with pressure waves at different frequencies and intensities. On one hand, pressure pulses increase penetrating performance of the jet, and on another hand, wave disturbances in the stratum intensify mass exchange and cause inflow of fluid to increase. In addition, wave disturbances in the pipe string and in the annular space will increase efficiency of cleaning off sediments.

Varying pressure pulse frequency in time will ensure more even treatment of stratum layers located near the key seat and away from it, and will reduce time of operation at resonance and near-resonance frequencies, which will significantly increase work safety.

All the afore-mentioned in combination will significantly reduce operation time and operational costs.

Before the operations begin, pipe string extension δ due to operational pressure is determined, as well as the natural oscillation frequencies of the pipe string together with the motor and hydroperforator.

The natural oscillation frequency of the pipe string is determined per formula /1/:

$$\omega = \left((2n-1)\sqrt{\frac{E}{\rho}}\right) \Big/ 4L, \text{ measured in Hz,} \tag{1}$$

here n is the number of the harmonic of the natural oscillation;

E is the modulus of elongation of the pipe string material. If the pipe string is made of the steel N80, E=210 000 MPa;

is the density of the pipe string material. The density of the steel the pipe string is made of is 7830 kg/m$^3$.

L is the length of the pipe string, together with the motor and hydroperforator.

The calculations were done for different values of L, namely, for 1000 m, 2000 m, and 3000 m. The results of calculations are shown on FIG. 3 in Table 1. Further calculations were done for the length of the pipe string together with the motor and hydroperforator being 3000 m.

A, the amplitude of the forced longitudinal oscillations of the pipe string, is calculated by the formula:

$$A = \frac{\delta}{\sqrt{\left(1-\frac{\Omega^2}{\omega^2}\right)^2 + \frac{4N^2\Omega^2}{\omega^4}}}, \tag{2}$$

here Ω is the frequency of forced oscillations of the pipe string;

N is the damping parameter. When N=0, oscillations do not damp;

δ is the pipe string extension caused by static force P, determined by the formula:

$$P=P_{ext}3.14R^2 \tag{3}$$

Here $P_{ext}$ is excessive pressure in the pipe string caused by injection pumps and pressure pulsators. For the calculations, the value of $P_{ext}$=15 MPa is taken (pumps and pressure pulsators work in synchronism, on the same frequency);

R is the internal radius of the pipe.

Pipe string extension, δ, is determined by the formula:

$$\delta=PLK_{\Delta P}/ES, \tag{4}$$

Here S is the pipe cross-section area, measured in m2, and the pipe thickness is taken as 0.00645 m;

$K_{\Delta P}$ is the pressure loss in the pipe string, annular space, on the hydromonitor nozzles and in the external connection piping of the equipment.

Calculations by formula (4), with the use of formula (3), for the pipe 3000 meters long, showed that the extension δ under static force P would make 0.1 meters.

A, the resonance amplitude of the forced longitudinal oscillations of the pipe string (provided that Ω=ω) caused by the pumps operation and pressure drops, for N=0.5, for the first three frequencies of natural oscillations, can be calculated by the formula:

$$A=\delta(2.64\ldots13.2). \tag{5}$$

The analysis of formula (5) shows that the pipe string extension may increase from 0.1 meters to 0.26 . . . 1.3 meters (i.e. can in fact cause rupture (destruction) of the pipe string due to resonance.

If the damping parameter is equal to 0.1, the risk of destruction of the pipe string or other well elements increases even more.

To reduce loads on the pipe string, it is necessary to shorten the time of operations at the resonance frequencies as much as possible. It is expedient to operate for a long time at the frequencies obeying the following conditions:

$$\Omega=(0.001 \ldots 0.75)\omega; \quad (6)$$

$$\Omega=(1.25 \ldots 2.5)\omega. \quad (7)$$

Specific modes of operations will be described below.

Thus, before the operations commence, frequencies of natural oscillations are determined for the pipe string. The results of those calculations will make the starting data (or restrictions) to set the modes of operation for pressure pulsators and other mechanisms that will make it possible to change pressure in the pipe string over time.

The equipment used to implement the method is subdivided into surface and subsurface equipment.

The subsurface equipment includes: pipe string 1 (FIG. 1), subsurface device 13 for the hydroperforator axial movement 2. The subsurface device for the hydroperforator axial movement contains a cylindrical casing 14 and a hollow rod 15 installed coaxially with it, which is rigidly connected to the hydroperforator 2 in its lower part and is capable of moving against the casing. That hollow rod together with the casing make a ring chamber filled with viscous liquid. A piston 16 is attached to the hollow rod. The ring chamber is divided into two sections, 17 and 18, by the wall having a channel 19 for the liquid to flow through. In the upper part of the ring chamber, a spring 20 is located which enables movement of the piston and the rod against the casing.

Figure 2:
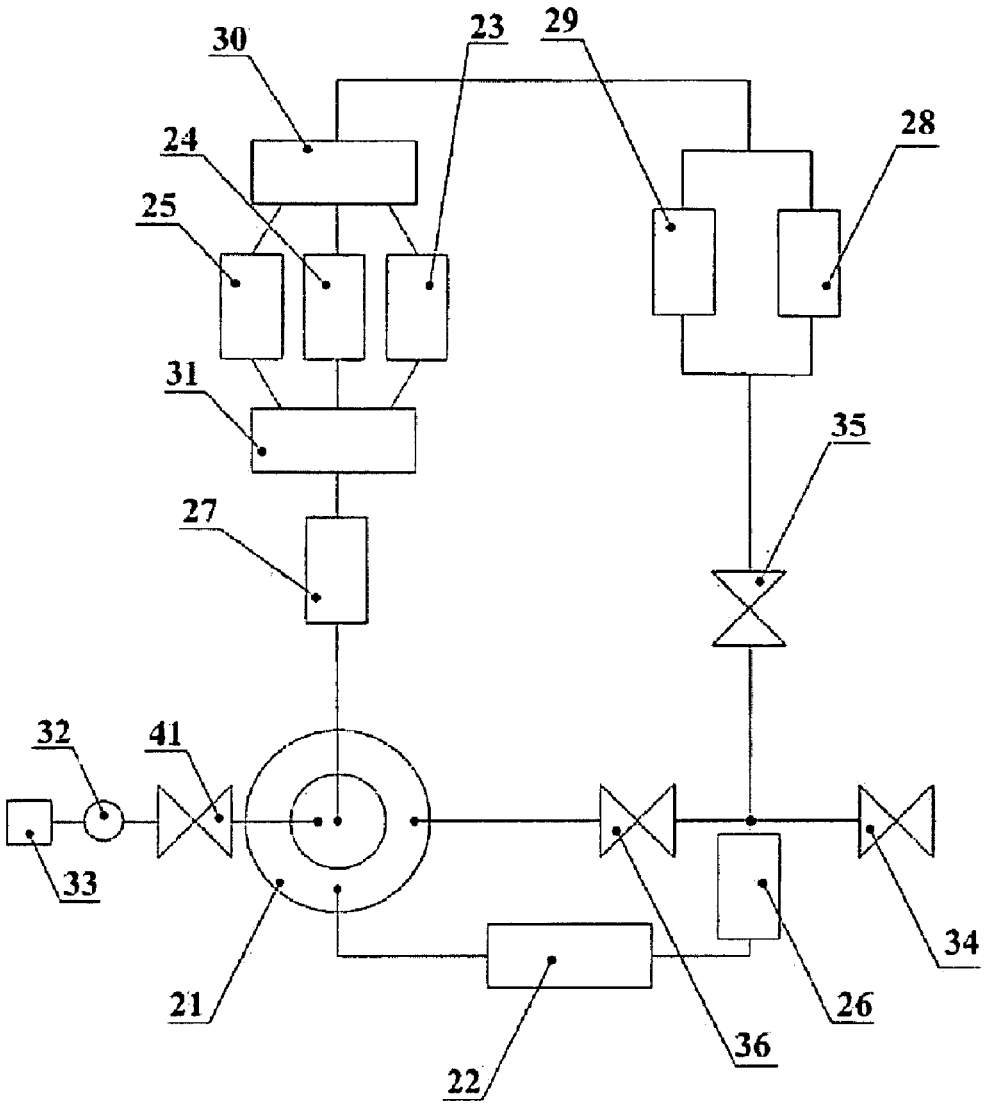
FIG. 2 shows the surface equipment required to implement the method of well production rate increase.

The surface equipment includes: wellhead 21 (FIG. 2) with inlet elbow 69 (FIG. 1) and outlet elbow 70 (FIG. 1); vessel 22 with a volume of, for example, 30 $m^3$; plunger-type pumping units 23, 24, 25, which enable an interchangeable supply of liquid with abrasive material (in particular, with sand) at flow rates of 11.5 to 18 liters per second (in addition, a mode with 1 to 5 l/s flow rates is possible), at pressures from 50 MPa to 32 MPa, with a maximum pressure value of 80 MPa; pump 26 for pumping liquid out of the vessel 22; filters 27, 28, and 29; machine 30 to blend liquid and the abrasive material (it is also known as a sand-blender unit); block of manifolds 31; pressure gauge 32 connected to the pipe string via the tap valve 41; computing device 33 to process data gathered by the pressure gauge. The elements of the surface equipment are interconnected with pipelines.

Before operations begin, the frequencies of natural axial oscillations are determined for the pipe string and other elements of the surface equipment. Natural oscillations for the elements of the surface equipment are calculated by methods shown in the source /1/.

Subsequent operations begin with checking operation capability of the subsurface device for the hydroperforator axial movement, as well as the hydroperforator itself. The subsurface device for the hydroperforator axial movement and the perforator are connected to pump 26 via the tap valve 34 (FIG. 2), while tap valves 35 and 36 stay closed. Operation capability is checked with the aid of liquid not containing abrasive material. The length of the jet in the air is up to 5 meters, i.e. up to 50 times the hydroperforator diameter. Jet penetration depth in the ground is up to 3 meters.

Figure 7:
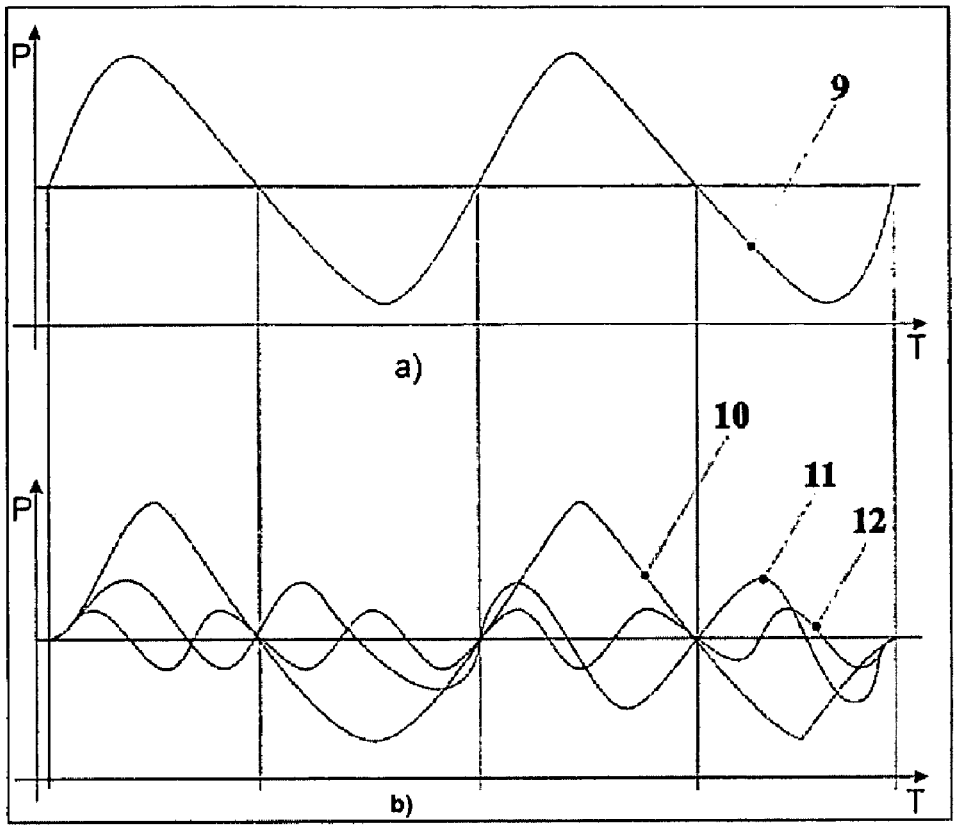
FIG. 7 shows the pressure changes over time (a), it is performed in such a way that it includes pressure oscillation components with different frequencies (b).
Figure 8:
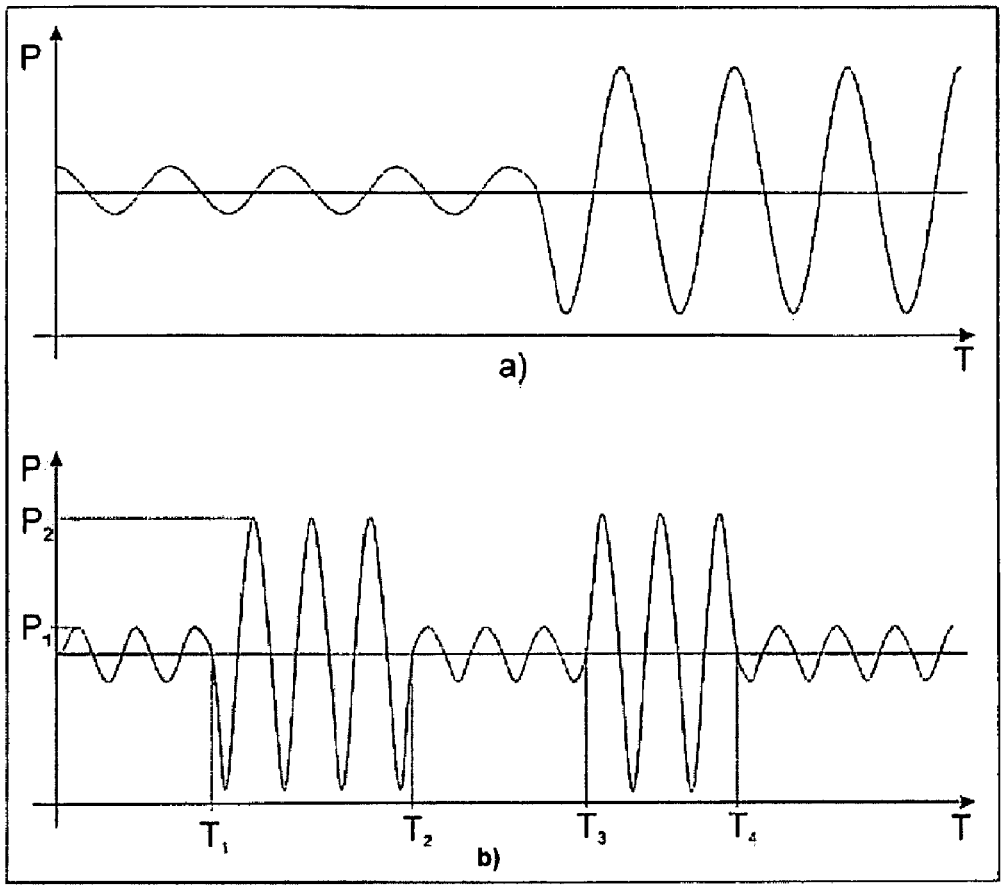
FIG. 8 shows two charts of pressure changes over time. The (a) chart shows pressure changes over time with the variable amplitude, and (b) chart shows pressure changes over time with periodical changes of the amplitude over time.
Figure 9:
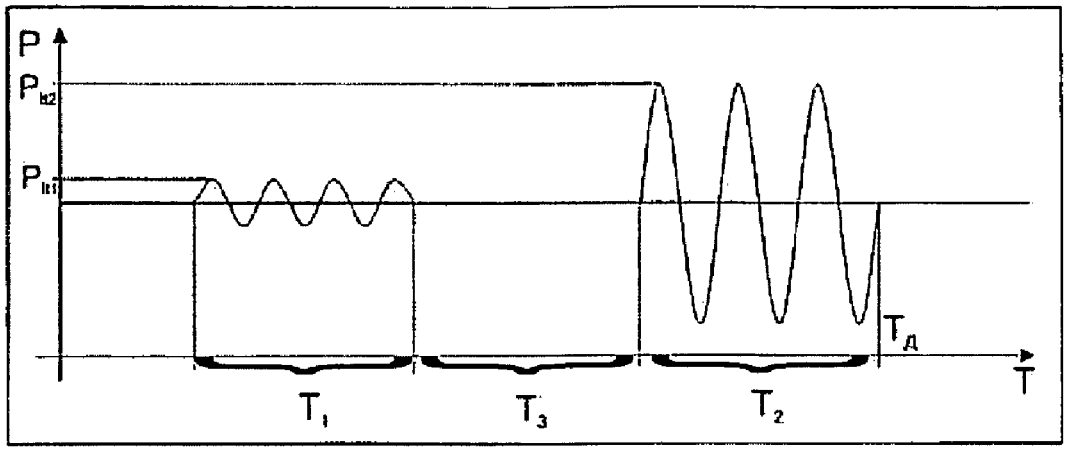
FIG. 9 shows the i-th component of the pressure oscillations, for which, within the time interval $T_d$, the peak value of pressure $P_{it1}$ within the T1 time period differs from the peak value of pressure $P_{it2}$ within the T2 time period. Within the T3 period, the peak value of pressure is zero.

The method of well production rate increase includes: lowering the hydraulic perforator (hydroperforator) 2 equipped with hydromonitor nozzles 3 and 4 into the well on the pipe string 1; pumping liquid 5 with abrasive material under pressure into the pipe string and hydroperforator; impacting the well elements (production casing 6, cement stone 7) and the stratum 8 with jets 42, 43 of the liquid with abrasive material via hydroperforator hydromonitor nozzles 3 and 4. When liquid with abrasive material impacts the well elements and the stratum, pressure is changed in the pipe string 1 delivering liquid with abrasive material. When liquid with abrasive material impacts the well elements and the stratum, pressure 9 is changed over time (see FIG. 7*a*) so that pressure oscillations always include components 10, 11, 12 (see FIG. 7*b*) with different frequencies, and in doing so, peak values (amplitudes) of some or all pressure oscillation components change within time interval $T_d$, as shown in FIG. 8*a*, or FIG. 8*b*, or FIG. 9.

Upon lowering hydraulic perforator 2 into the well on pipe string 1, the pipe string, subsurface device for the hydroperforator axial movement, and the hydroperforator itself should be pressure tested. The pressure test is performed by applying pressure to the pipe string mouth which by 1.15 to 3 times exceeds the operating pressure (pipe string mouth pressure when the well elements and the stratum are impacted by the liquid with abrasive material via the hydroperforator hydromonitor nozzles). When the maximum operating pressure is equal to, for example, 40 MPa, test pressure would be 60 MPa.

Upon completion of the pressure test, it is expedient to perform another intermediary operation, flushing pipe string 1 and annular space 37. Flushing is performed by pressure pumping of chemicals (e.g. KCl) solution by the pump 25 into the pipe string 1, hydroperforator 2 and the annular space 37. In doing so, pressure is changed in the pipe string used for delivery of the solution for flushing the well. Pressure is changed by pressure pulsators 38, 39 and 40, installed at the well mouth. As a result of flushing, hydraulic resistance may be significant in the pipe string and in the annular space.

Figure 5:
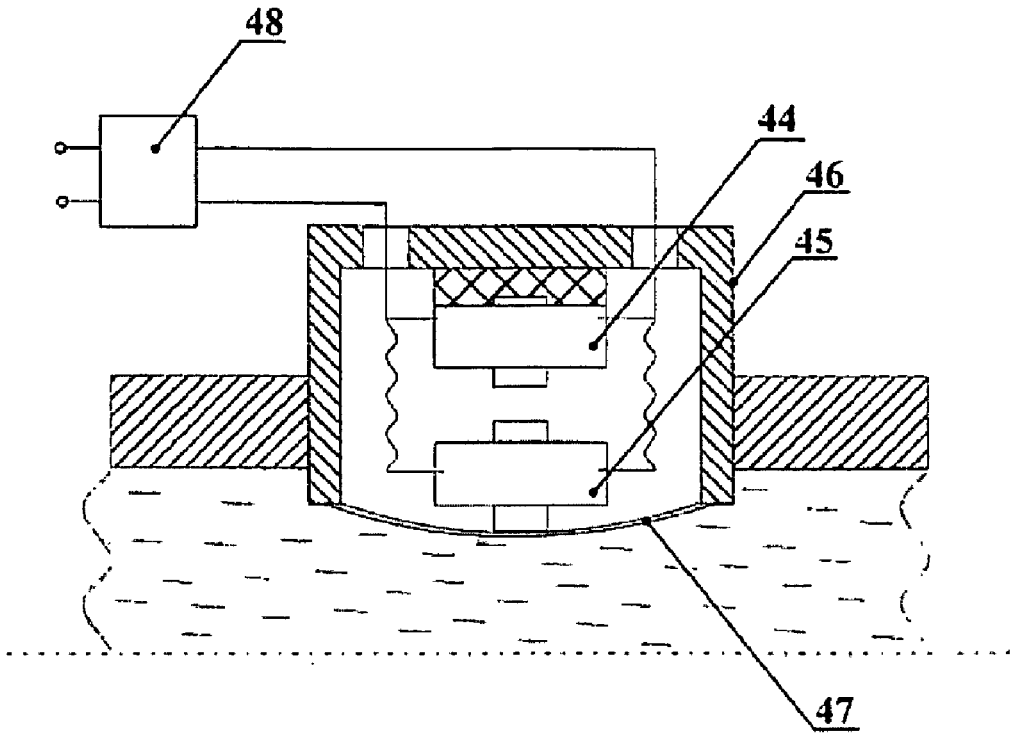
FIG. 5 shows the layout diagram for the electrohydraulic pulsator.

As pressure pulsators, electrohydraulic pulsators are used. The simplest electrohydraulic pulsator consists of two electromagnets 44 and 45 (see FIG. 5) enclosed in casing 46. Membrane 47 is in contact with the liquid. The electromagnets are powered by power supply 48. The electromagnet windings are connected in such a way that when electric current flows through them, the electromagnets repel. The pressure pulse frequency is driven by power supply 48.

Figure 6:
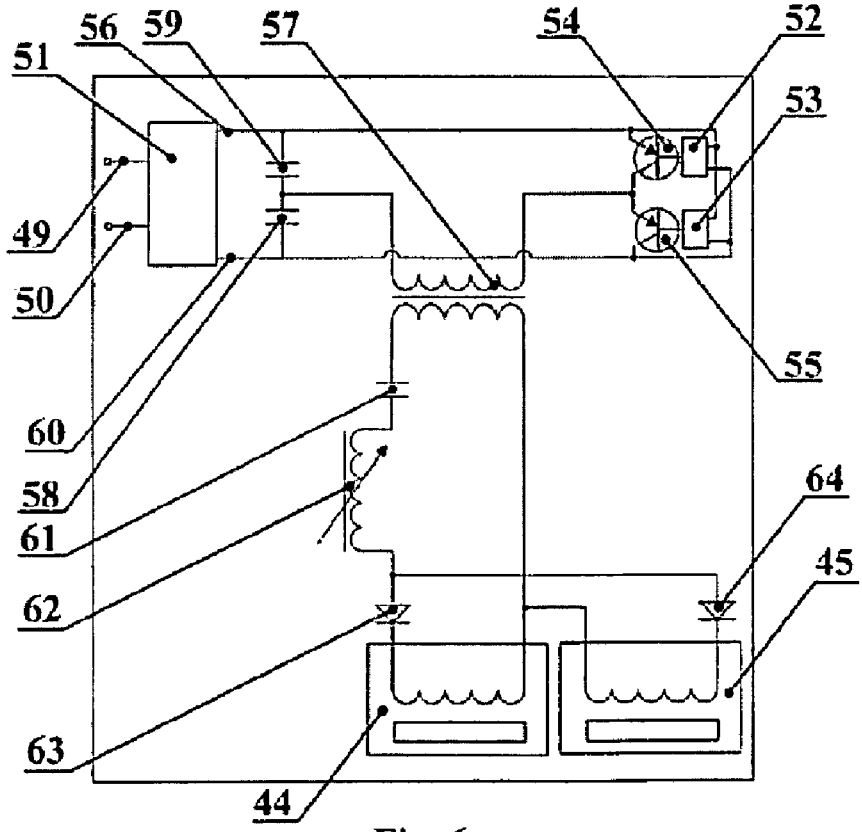
FIG. 6 shows the electrical schematic diagram of the power supply for the pressure pulsator.

The electrical schematic diagram of the power supply is shown on in FIG. 6. Alternating voltage and current are applied to terminal clamps 49 and 50, after which current is rectified by passing through diode rectifier 51. Frequency of the electric pulses is driven by driving oscillators 52 and 53, which intermittently open and close transistors 54 and 55. When transistor 5 is open, electric current flows from positive terminal 56, via transistor 54, through transformer 57 primary winding, through condenser 58, to negative terminal 60. Thus, alternating current is generated in the secondary winding of transformer 57, which passes through condenser 61 (compensating the inductive impedance of the inductance coil), adjustable inductance coil 62, via diodes 63 and 64, to electromagnets 44 and 45. The amplitude of the pressure oscillations depends on the intensity of current passing through the electromagnet's windings, and can reach 3 MPa.

Thicknesses of sediments deposited on the pipe surfaces that are treated with pressure waves may be from tenths of a millimeter to several millimeters; therefore, to effectively crush sediments, pressure pulsators need to operate at frequencies ranging from 250 to 15,000 Hz. The recommended mode of operation of three electrohydraulic pressure pulsators (#1, 2, and 3) in the process of flushing is shown in Table 3, FIG. 11. Flushing is performed within, for example, 10 minutes. Modes of operation of the pulsators #1 and #2 are changed every minute, as their operational frequencies are close to the frequencies of natural oscillations of the surface pipelines of smaller lengths (up to 10 meters) and of the actuating elements of the pumping units. The effective depth of penetration for the waves of such a frequency is up to 1 mm.

Sand with particles size (for example) from 0.001 mm to 2-3 mm. is used as an abrasive material. As the carrier liquid, water with different additives is normally used (in particular, for example, stratal water with surfactants and carboxymethylcellulose), but also a hydrocarbonic liquid may be used, e.g. degassed oil. However, oil is expensive and inflammable. To increase density, solutions of, for example, calcium chloride and bischofite may be added to water.

Abrasive material is blended with carrier liquid in the sand-blender unit, with the blend pumped through the well at flow rates of, for example, 2-5 l/s, sometimes up to 18 l/s, and supplying the abrasive material to the liquid in the amounts of 30-100 g/l, sometimes up to 180-250 g/l.

A hydropulsator with the helical working mechanism may also be used as the pressure pulsator. The pressure pulses amplitude for such a pulsator may reach 5 MPa at the frequencies 15-20 Hz /3/.

In the disclosed method of well production rate increase, pressure is changed over time in a way that for some components of the pressure oscillations, the peak pressure values (amplitudes) are changed within the $T_d$ time interval. The $T_d$ time interval may consist of one period of time or of several consecutive periods. In Table 2, FIG. 4, recommended modes of operation are shown for the hydraulic jet perforator and pressure pulsators in the process of slotting well elements and the stratum. The operating pressure at the well mouth, when pulsators are turned off, is 40 MPa.

Recommended modes of operation for electrohydraulic pressure pulsators # 1, 2 and 3 are as follows:

The pressure amplitude for=pulsator # 1 is changed every 5 minutes, as its operating frequencies are close to the lowest normal oscillations frequencies for the pipe string.

The pressure amplitude for=pulsator # 2 is changed every 5-15 minutes, as its operating frequencies are close to the normal oscillations frequencies of the surface equipment elements (electromotor driven pumps operating at the commercial frequency of current).

The pressure amplitude for pulsator # 2 is changed every 5-15 minutes, as its operating frequencies are close to the normal oscillations frequencies of the surface pipelines of smaller lengths (up to 10 meters) and of the actuating elements of the pumping units.

Pressure oscillation frequencies within the range of 1-5 Hz, with an amplitude of 3 MPa, effectively amplify the impact of the jet, and also effectively transfer the energy of pressure waves in the stratum up to one meter in depth from the key seat.

Pressure oscillation frequencies within the range of 60-80 Hz, with an amplitude of 1 MPa, amplify the impact of the jet, and also effectively transfer the energy of pressure waves in the stratum up to a few tens of centimeters in depth from the key seat.

Pressure oscillation frequencies within the range of 150-300 Hz, with an amplitude of 0.3 MPa, effectively transfer the energy of pressure waves in the stratum up to tens of millimeters in depth from the key seat, thus preparing the stratum layer for the impact by the jet.

Operation of pulsator #1 from the $25^{th}$ to the $35^{th}$ minutes of operation may be illustrated by a graph shown in FIG. 8*a*, where the pressure amplitude increased in a step. Operation of the same pulsator from the $25^{th}$ to the $50^{th}$ minute may be illustrated by a graph shown in FIG. 8*b*, where the pressure amplitude increased in a step at moment T1 ($30^{th}$ minute), then decreased at moment T2 ($35^{th}$ minute), then increased at moment T3 ($40^{th}$ minute), then decreased at moment T2 ($45^{th}$ minute).

Operation of pulsators #2 and 3 from the $15^{th}$ to the $35^{th}$ minutes of operation may be illustrated by a graph shown in FIG. 9, where the pressure amplitude increased in a step after period T3. Within time period T1, from the $15^{th}$ to the $20^{th}$ minutes, at a frequency of 150 Hz, the pressure oscillations amplitude was 0.3 MPa. Within time period T2, from the $20^{th}$ to the $25^{th}$ minutes, pulsators # 2 and 3 are turned off, and from the $25^{th}$ to the $30^{th}$ minutes (T2 time period), pulsator # 2 generates oscillations with an amplitude of 1 MPa at a frequency of 150 Hz.

On graph FIG. 9, $P_{it1}$ is the pressure increment arising due to the pressure oscillations at 150 Hz (i=150) with an amplitude of 0.3 MPa, generated by pulsator #3 within time period T1. $P_{it2}$ is the pressure increment arising due to the pressure oscillations at 150 Hz (i=150) with an amplitude of 1 MPa, generated by pulsator #2 within time period T2.

To generate oscillations at frequencies between 0.001 and 1 Hz, pumping units with pressure values adjustable in the range of 6 to 60 MPa may be used. To switch the mode of operation of the pumping unit (tuning to the required frequency and amplitude), tens of seconds to tens of minutes are required.

When the above example is implemented, from the $15^{th}$ to the $30^{th}$ minutes, at the pressure oscillation frequency 150 Hz, within time interval $T_d$=15 min, the peak value of $P_{it1}$ pressure is lower than the peak value of $P_{it2}$ pressure by 3.3 times (lying within the range of factors 1.01-100). That range (1.01-100 times) may be most readily implemented for all pulsator types.

Figure 10:
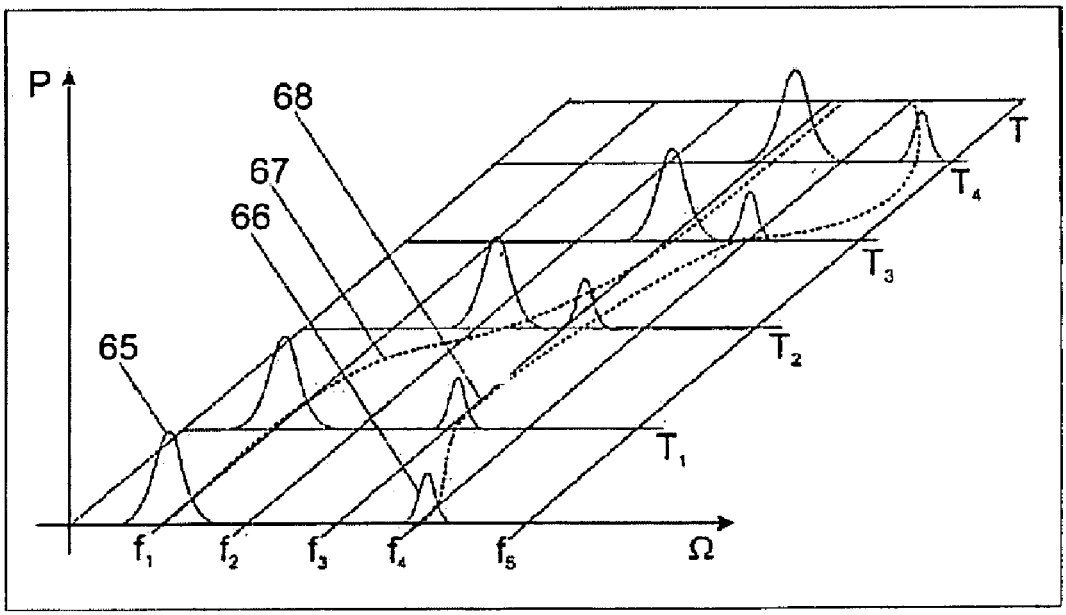
FIG. 10 shows the changes over time of the peak value (amplitude) of pressure for different frequencies.

FIG. 10 shows changes in time of the pressure peak value (amplitude) for different frequencies. The graphs of such a type are plotted with the aid of a computer, based on the pressure gauge measurements. For plotting, the frequency analysis method /2/ was used. At the initial moment, maximum amplitudes 65 and 66 are generated at f1 and f4 frequencies, as well as at the frequencies close to f1 and f4. At moment T1, maximum amplitudes are generated at f1 and f3 frequencies. At moment T2, maximum amplitudes are generated at f2 and f3 frequencies. At moment T3, maximum amplitudes are generated at f3 and f4 frequencies. At moment T4, maximum amplitudes are generated at frequencies ranging between f3 and f4, and at those ranging between f4 and f5. Curves of changes of maximum amplitudes against time and frequency—curves 67 and 68—are shown on the graph.

The graphs of such a type allow total analysis of the processes of changes of maximum amplitudes against frequency and time.

After liquid with abrasive material impacts the well elements and the stratum, the well and the stratum key seat are flushed and treated with a solution—for example, of KCl. In doing so, pressure is changed in the pipe string used to deliver the solution required for flushing the well.

The recommended mode of operation for the three electrohydraulic pressure pulsators, # 1, 2, and 3, in the process of flushing and treating the well, is shown in Table 4, FIG. 12. Flushing is performed for 30 minutes.

Pulsator #1 operates at the frequencies from 0.1 to 1 Hz. For the minimum time, the pulsator operates at the frequencies close to 0.42 Hz (that is the first frequency of natural oscillations of the pipe string). The pulsator operation is targeted to treat deep-seated layers of the stratum with the pressure waves. The flushing liquid fills all the inner holes of the well, including slot key seats, which may be several in number (on the FIG. 1, four slot key seats are shown). The main purpose for changing pressure in the pipe string, as it was mentioned earlier, is to generate pressure pulses in the jet of the abrasive material flowing out of output ports (nozzles) of the hydromonitor head pieces when slot key seats are being created. Pressure pulses at different frequencies ensure slotting a deeper key seat and also stimulate mass exchange processes in the layer both near the slot key seat and away from it.

It is reasonable to combine the flushing process with the chemical treatment of the stratum. Then the well and the key seat in the stratum are to be flushed with the solution having acidic reaction, or alkaline reaction, or consecutively with solutions with acidic and alkaline reactions, and in doing so, pressure is changed in the pipe string used to supply the solution. Pressure pulses at different frequencies stimulate processes of the solutions interaction with clayish formations located in the stratum (collector) both near the key seat surface and tens of centimeters away from it. Frequencies at which pressure oscillation components are generated by the pulsators during chemical treatment should be selected within the range 60 to 10,000 Hz.

When the method is implemented, liquid with abrasive material impacts the well elements and the stratum via hydromonitor nozzles of the hydroperforator; it is done on both sides of the well bore in diametral opposite directions covering the full depth of the productive stratum. In doing so, the perforator is moved progressively along the well axis and, possibly, rotates about the well axis within the productive stratum interval. As a result, a linear and possibly a helical key seat is created at least h in width, 5 to 10 times the well diameter in length, and the stratum slot relief is achieved. Here $$h=(4*P*(a+d)*(1-m^3))/E_p, \quad (8)$$

P is the lithostatic pressure at the depth of the stratum treated;

a is the length of the linear key seat in one direction from the well;

d is the diameter of the well;

m is the Poisson number for the productive stratum;

$E_p$ is the elasticity modulus for the productive stratum.

Parameters h, a and d determine the area of the surface separating the key seat from the stratum. It is through that area that the stratum is treated with pressure waves. Increase of the area allows reduction of treatment time, and decrease of the area requires an increase in the time of the stratum treatment with pressure waves.

To improve work safety, it is expedient to interconnect the elements of the surface processing facilities (pumps, filters, pipes, etc.) with the aid of coupling devices manufactured in a way that the amplitude of forced oscillations of the coupled devices could be changed. The main element of any coupling is a gasket ensuring tightness of the coupling in the relatively broad range of compression forces, e.g. between flanges. The value of the damping parameter depends on compression of the gasket. The gasket is selected experimentally; it may be a rubber gasket, several layers of rubber gaskets, or several layers of alternating rubber and plastic gaskets.

Thus, the invention can be implemented. In the process of its implementation, the following positive technical results will be achieved:

reduced operation time required to increase well production;

effective cleaning of sediments off the inner and outer surface of the pipe string and off the inner surface of the production casing;

evenly impacting with pressure waves the short-range and long-range layers of the stratum adjacent to the surface of the key seat impacted by liquid with abrasive material;

enhancement of the equipment elements' performance reliability in the process of slotting the well production casing, behind-the-casing cement stone, and rocks of the productive stratum.

What is claimed is:

1. A method of increasing well production rate, comprising:

lowering a hydroperforator equipped with hydromonitor nozzles into a well on a pipe string;

pumping liquid with abrasive material into the pipe string and hydroperforator under an influence of a time varying pressure, impacting thereby well elements and a stratum with the liquid with abrasive material via the hydroperforator hydromonitor nozzles;

wherein the time varying pressure includes multiple harmonic frequency components;

wherein a peak value of at least one harmonic frequency component of the time varying pressure changes within the time interval of impact of the liquid with the abrasive material on the well elements and the stratum via the hydroperforator hydromonitor nozzles; and wherein prior to pumping the liquid with abrasive materials into the pipe string and hydroperforator, the well is flushed to its bottom by pressure pumping of a well flushing solution into the pipe string, hydroperforator and a well annular space under an influence of a time varying pressure, wherein the flushing solution includes at least one chemical.

2. The method according to claim 1, wherein a peak value of at least one harmonic frequency component of the time varying pressure increases within the time interval of impact of the liquid with the abrasive material on the well elements and the stratum via the hydroperforator hydromonitor nozzles.

3. The method according to claim 1, wherein a peak value of at least one harmonic frequency component of the time varying pressure decreases within the time interval of impact of the liquid with the abrasive material on the well elements and the stratum via the hydroperforator hydromonitor nozzles.

4. The method according to claim 1, wherein a peak value of at least one harmonic frequency component of the time varying pressure changes step-wise within the time interval of impact of the liquid with the abrasive material on the well elements and the stratum via the hydroperforator hydromonitor nozzles.

5. The method according to claim 4, wherein a peak value of the time varying pressure changes by a factor of 1.01 to 100.

6. The method according to claim 4, wherein the peak value of at least one harmonic frequency component of the time varying pressure changes by a factor of 1.01 to 100.

7. The method according to claim 4, wherein the peak value of at least one harmonic frequency component of the time varying pressure changes by a factor of 100 to 1.0.

8. The method according to claim 1, wherein the time varying pressure influencing pressure pumping of the well flushing solution includes multiple harmonic frequency components; and wherein a peak value of at least one harmonic frequency component of the time varying pressure changes within the time interval of flushing the well to the bottom.

9. The method according to claim 1, wherein prior to flushing the well with the well flushing solution, a pressure test of the pipe string and the hydroperforator is performed by applying a time varying test pressure to a pipe string mouth, which test pressure by 1.15 to 3 times exceeds the pressure applied for pumping the liquid with the abrasive material.

10. The method according to claim 9, wherein the time varying test pressure hydroperforator, includes multiple harmonic frequency components; and wherein a peak value of at least one harmonic frequency component changes within the time interval of the pressure test.

11. The method according to claim 1, whereby after the liquid with the abrasive material impacts the well elements and the stratum, the well and a stratum key seat are flushed and treated by pressure pumping of a well flushing solution including at least one chemical combined with a solution including a mineral salt, under an influence of a time varying pressure.

12. The method according to claim 1, wherein after the liquid with the abrasive material impacts the well elements and the stratum, the well and a stratum key seat are flushed and treated by pressure pumping of a well flushing solution including at least one chemical combined with a solution having acidic or alkaline reaction, under an influence of a time varying pressure.

13. The method according to claim 11, wherein the time varying pressure influencing the well and stratum key seat treatment includes multiple harmonic frequency components, and wherein a peak value of at least one harmonic frequency component of the time varying pressure changes within the time interval of the well and stratum key seat treatment.

14. The method according to claim 13, wherein a peak value of at least one harmonic frequency component of the time varying pressure increases within the time interval of the well and stratum key seat treatment.

15. The method according to claim 13, whereby a peak value of at least one harmonic frequency component of the time varying pressure decreases within the time interval of the well and stratum key seat treatment.

16. The method according to claim 13, whereby a peak value of at least one harmonic frequency component of the time varying pressure changes by a factor of 1.01 to 100 times within the time interval of the well and stratum key seat treatment.

17. The method according to claim 1, wherein the perforator is moved progressively along a well axis and rotates about the well axis within a productive stratum interval, resulting in creating of a linear and a helical key seat, which is 5 to 10 times the well diameter in length, and achieving a stratum slot relief.

18. The method according to claim 1, wherein the liquid with abrasive material is pumped under pressure into the pipe string and hydroperforator with an aid of at least one device selected from the group consisting of a pump and a gas pressure accumulator.

19. The method according to claim 1, whereby the pressure is changed in the pipe string by a pressure pulsator.

20. The method according to claim 1, wherein the at least one chemical is included in the flushing solution with a density of 0.70 to 1.35 g/cm$^3$.

21. The method according to claim 1, wherein the at least one chemical is included in the flushing solution with a density of 2.0 to 3.5 g/cm$^3$.

* * * * *